US011429128B2

(12) United States Patent
Matej et al.

(10) Patent No.: US 11,429,128 B2
(45) Date of Patent: Aug. 30, 2022

(54) VOLTAGE PRE-REGULATOR HAVING POSITIVE AND NEGATIVE FEEDBACK

(71) Applicant: SEMICONDUCTOR COMPONENTS INDUSTRIES, LLC, Phoenix, AZ (US)

(72) Inventors: Jan Matej, Ostrava (CZ); Barbara Pankova Maludova, Frydek-Mistek (CZ)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 31 days.

(21) Appl. No.: 17/248,119

(22) Filed: Jan. 11, 2021

(65) Prior Publication Data

US 2022/0221888 A1 Jul. 14, 2022

(51) Int. Cl.
*G05F 1/575* (2006.01)

(52) U.S. Cl.
CPC ..... *G05F 1/575* (2013.01)

(58) Field of Classification Search
CPC . G05F 1/575; G05F 1/61; G05F 1/614; G05F 1/569; G05F 1/571; G05F 1/573
See application file for complete search history.

(56) References Cited

U.S. PATENT DOCUMENTS

2005/0140350 A1 6/2005 Kitagawa et al.
2005/0168270 A1* 8/2005 Bartel ..... G05F 3/30 327/539
2011/0121885 A1 5/2011 Liu
2012/0319665 A1* 12/2012 Hu ..... G05F 1/561 323/273
2020/0205978 A1* 7/2020 Padala ..... A61F 2/246

FOREIGN PATENT DOCUMENTS

CN 109428474 A 3/2019

OTHER PUBLICATIONS

Zhuangguang Chen et al., "On-Chip High-Voltage Buffer Design for Implantable Neural/Muscular Stimulators," 2019 IEEE International Conference on Integrated Circuits, Technologies and Applications.
ON Semiconductor, "LDO Regulator, 150 mA, 38 V, 1 μA 1Q, with PG," Mar. 2020.
European Patent Office, "European Search Report," European Application No. 22150779.1-1012, dated May 30, 2022.

* cited by examiner

*Primary Examiner* — Nguyen Tran
(74) *Attorney, Agent, or Firm* — Brake Hughes Bellermann LLP

(57) ABSTRACT

A voltage pre-regulator can receive a variable voltage in a middle voltage range (e.g., dozens of volts) and provide a regulated voltage in a safe operating region of a low voltage device. The use of the voltage pre-regulator can allow circuits to use low voltage devices to perform additional regulation/conversion without fear of damage. The voltage pre-regulator disclosed herein can perform the voltage reduction and regulation functions of pre-regulation with commonly used transistor types because the disclosed circuits and method use a bias circuit. The bias circuit uses positive feedback so that no additional start-up circuitry is required. The positive feedback is controlled by negative feedback so that the pre-regulator is able to provide a regulated voltage that is stable over a range of input voltages and temperatures.

21 Claims, 7 Drawing Sheets

VOLTAGE PRE-REGULATOR HAVING POSITIVE AND NEGATIVE FEEDBACK

FIELD OF THE DISCLOSURE

The present disclosure relates to integrated circuits for voltage regulation and more specifically to a linear voltage regulator that can be started and controlled using positive and negative feedback.

BACKGROUND

A voltage regulator is a circuit configured to convert a fluctuating input voltage at an input to an output voltage at an output that is essentially fixed. For example, a linear voltage regulator may utilize a controllable voltage drop between an input and an output in order to compensate for changes in the input voltage. For example, as the input voltage increases the controllable voltage drop can increase so that the output voltage remains fixed. Low voltage devices may be used to provide accuracy to the regulated output voltage but when the input voltage is high and the output voltage is low, it may be necessary to protect the low voltage devices from the high input voltages.

SUMMARY

In at least one aspect, the present disclosure generally describes a voltage pre-regulator. The voltage pre-regulator includes a bias circuit portion and a regulator circuit portion. The bias circuit portion includes a feedback loop that is configured to amplify a leakage current created by an input voltage so that the leakage current increases according to positive feedback to become an amplified leakage current. The bias circuit portion further includes a current source that is coupled to the feedback loop. The current source is configured to limit the increase of the amplified leakage current by applying negative feedback to the feedback loop so that the bias circuit portion outputs a bias current and a bias voltage. The regulator circuit portion includes a laterally diffused metal oxide semiconductor (LDMOS) transistor that is configured to generate a voltage drop from an input of the voltage pre-regulator to an output of the voltage pre-regulator based on the bias current and the bias voltage. The voltage pre-regulator is configured to output a regulated voltage based on the voltage drop.

In another aspect, the present disclosure generally describes a method for voltage pre-regulation. The method includes receiving an input voltage at a bias circuit portion of a voltage pre-regulator. The method further includes generating a bias current and a bias voltage using positive feedback and negative feedback in the bias circuit portion of the voltage pre-regulator and applying the bias current and the bias voltage to a regulator circuit portion of the voltage pre-regulator. The method further includes outputting a regulated voltage based on a voltage drop from the input voltage, where the voltage drop is generated by the bias current and the bias voltage.

In yet another aspect, the present disclosure generally describes a system that includes a low voltage device (e.g., a low voltage regulator) and a voltage pre-regulator. The low voltage device includes transistors that have a safe operating area in a low voltage range (i.e., low voltage safe operating area). The voltage pre-regulator that is coupled to an input voltage that is outside the low voltage safe operating area and that is configured to provide a regulated voltage to the low voltage device in the safe operating area. The voltage pre-regulator includes a bias circuit portion with a feedback loop that is configured to amplify a leakage current created by an input voltage to generate an amplified leakage current that increases according to positive feedback. A current source is coupled to the feedback loop to limit the increase of the amplified leakage current by applying negative feedback to the feedback loop so that an equilibrium is reached between the positive feedback and the negative feedback, where at the equilibrium, the bias circuit portion outputs a bias current and a bias voltage. The voltage pre-regulator further includes a regulator circuit portion with a laterally diffused metal oxide semiconductor (LDMOS) transistor that is configured to generate a voltage drop from an input of the voltage pre-regulator to an output of the voltage pre-regulator based on the bias current and the bias voltage, where the voltage pre-regulator is configure to output a regulated voltage based on the voltage drop.

In a possible implementation of the system, the low voltage device and the voltage pre-regulator are portions of a unitary integrated circuit.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The components in the drawings are not necessarily to scale relative to each other. Like reference numerals designate corresponding parts throughout the several views.

DETAILED DESCRIPTION

The present disclosure describes a voltage pre-regulator (i.e., pre-regulator) configured to convert a voltage in a middle voltage (i.e., MV) range to a voltage within a safe operating area (i.e., SOA) of low voltage (i.e., LV) devices. The MV range may be from approximately 10 volts (V) to approximately 100V, while the SOA for a LV device may be less than approximately 10V. The disclosed pre-regulator may provide a voltage suitable for conversion and/or regulation by a variety of LV circuits. The pre-regulator can help the conversion and/or regulation by these LV circuits to have lower power consumption, better noise performance, and/or higher precision.

The disclosed pre-regulator does not require special (e.g., uncommon, expensive, etc.) devices, such as a junction field effect transistor (JFET) or a depletion-mode laterally diffused metal oxide semiconductor (DM-LDMOS) transistor, in order to perform the pre-regulation. Instead, the disclosed pre-regulator can use a common MV transistor, such as the (more common) enhancement-mode laterally diffused metal oxide semiconductor transistor (i.e., LDMOS), to perform the pre-regulation because it includes bias circuitry that balances positive and negative feedback to control the common MV transistor for pre-regulation. This balanced feedback in the bias circuitry can ensure regulation within a startup time (e.g., less than about 1 millisecond (ms)) and can provide an output voltage that is stable (e.g., less than about 5% change) over a range of temperatures (e.g., from about −40 degrees Celsius (° C.) to about 150° C.) for a wide range of input voltages (e.g., from about 5V to about 70V).

Figure 1:
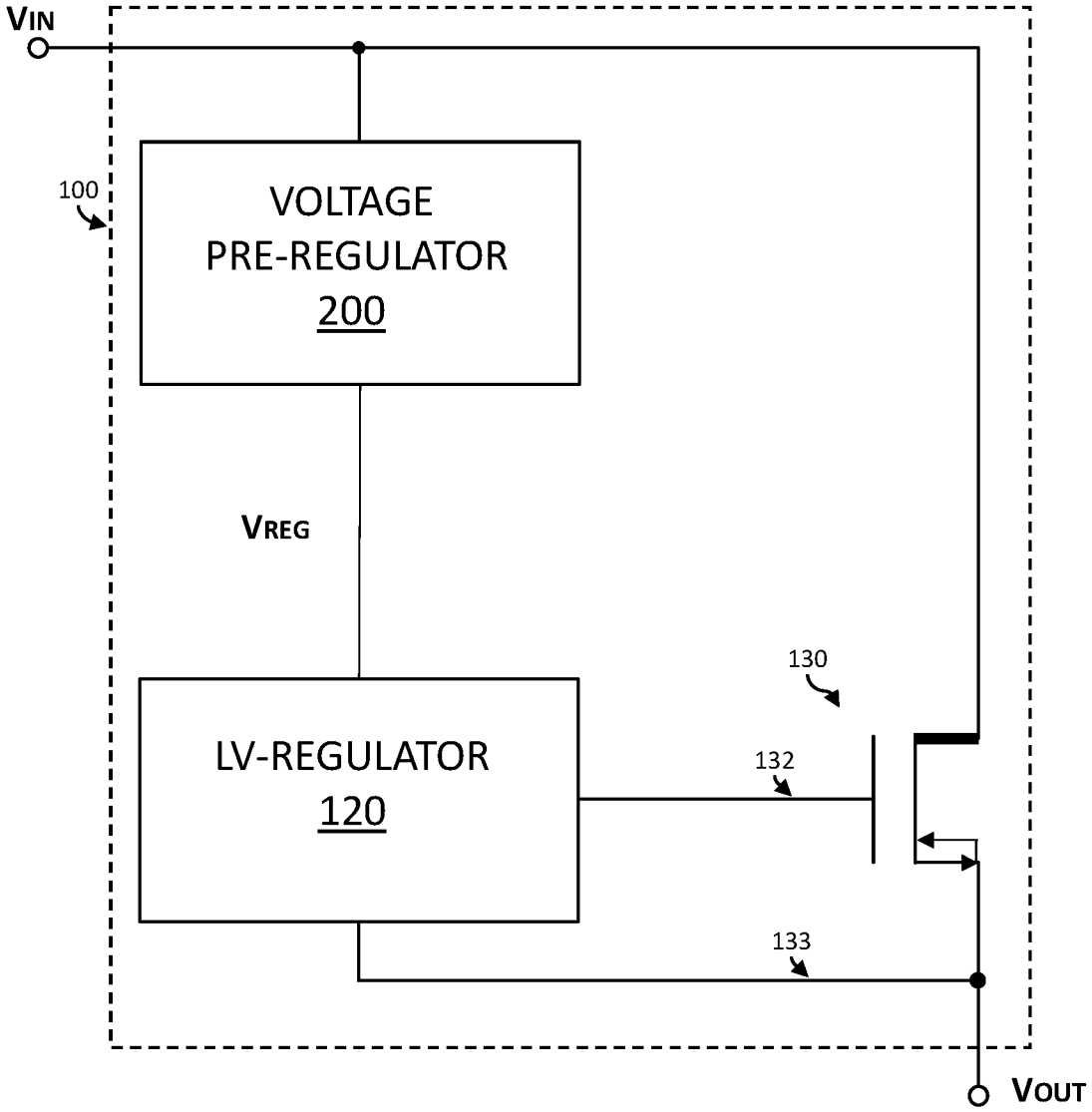
FIG. 1 is a block diagram of a voltage regulator including a voltage pre-regulator according to a possible implementation of the present disclosure.

FIG. 1 is a block diagram of a voltage regulator that includes a voltage pre-regulator according to an implementation of the present disclosure. The voltage regulator 100 can be configured to receive an input voltage (i.e., $V_{IN}$) that is in a MV range from about 10 volts (V) to about 100V (e.g., 40V) and to generate an output voltage (i.e., $V_{OUT}$) that is in a LV range from about 1V to about 10V (e.g., 5V). In other words, the voltage regulator 100 can be configured to drop voltages in a MV range to a voltage in a LV range.

The voltage regulator 100 is a linear regulator that regulates an output voltage ($V_{OUT}$) by adjusting a voltage drop across a transistor device 130. The transistor device 130 can be a LDMOS transistor that is configured to handle a voltage in the MV range at a drain terminal (e.g., shown as bold) and is configured to handle a voltage in the LV range at a gate terminal 132. The transistor device 130 is therefore coupled to a LV-regulator 120 that is configured to output a gate voltage in the LV range to control the voltage drop across the transistor device 130. For example, the LV-regulator 120 may use feedback 133 from the output to adjust the voltage drop so that the output remains stable within a desired precision (e.g., within 1%).

To provide a desired output precision, the LV-regulator can include LV devices, each having a SOA (e.g., in the LV range). To prevent damage of the LV devices, the voltage regulator 100 further includes a voltage pre-regulator 200 that is configured to convert the input voltage ($V_{IN}$), which is in the MV range to a regulated voltage ($V_{REG}$), which is in the SOA of the LV devices of the LV-regulator 120. Accordingly, the regulated voltage ($V_{REG}$) can be used to power the LV-regulator 120. In other words, the regulated voltage ($V_{REG}$) can be a supply voltage (i.e., secondary supply rail) for the LV-regulator 120. The voltage pre-regulator 200 is configured to protect (i.e., shield) the LV devices in the LV-regulator 120 from the input voltage ($V_{IN}$) which is outside the SOA of the LV devices (i.e., is a voltage in the MV range). In a possible implementation, the voltage pre-regulator 200 and the LV-regulator 120 are included as integrated circuits (ICs) within the same IC package.

Figure 2:
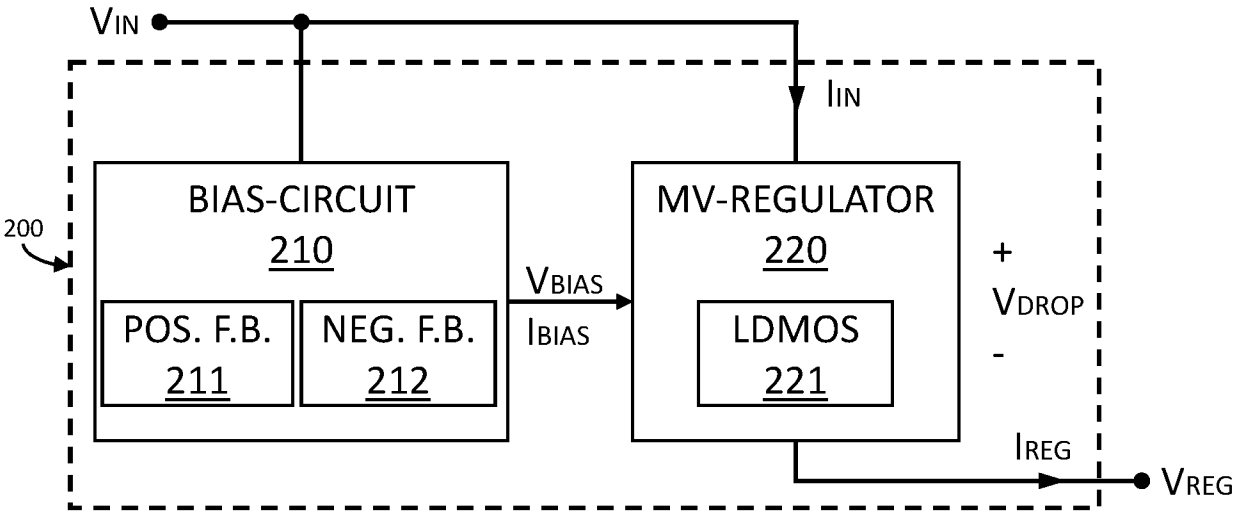
FIG. 2 is a block diagram illustrating a voltage pre-regulator according to an implementation of the present disclosure.

FIG. 2 is a block diagram illustrating a voltage pre-regulator according to an implementation of the present disclosure. The voltage pre-regulator 200 includes an MV-regulator 220 that is configured to provide a voltage drop ($V_{DROP}$) between and input and an output to provide a regulated voltage ($V_{REG}$) at the output. The voltage drop can be independent of the output current ($I_{REG}$) so that variations in a load coupled to the pre-regulator do not cause significant voltage changes (e.g., voltage droop) at the output. Additionally, the voltage drop ($V_{DROP}$) can be independent of the input current ($I_{IN}$) when an active device (e.g., transistor device) is used. Because the regulated voltage ($V_{REG}$) is provided for additional conversion and/or regulation, high precision is not required. For example, an accuracy of $V_{REG}$ may be 10 percent (%) or less. This accuracy may result from a tradeoff between voltage handling and precision. For example, the transistor device in the MV-regulator 220 may be able to handle a voltage in a MV range without damage but may generate a voltage drop that is less accurate (e.g., than a LV transistor device).

The use of a transistor device to generate the voltage drop ($V_{DROP}$) can require proper biasing. Some less common transistor types (e.g., JFET, DM-LDMOS) may be biased for this purpose by simply grounding a gate terminal or by pulling a gate terminal up from ground by a small amount. These less common transistor devices, however, may not be commonly available and/or may be more difficult to fabricate (e.g., with other devices). As mentioned, the voltage pre-regulator 200 and the LV-regulator 120 can be included as ICs within the same IC package (e.g., as portions of a unitary integrated circuit). In this case, a transistor device that can be fabricated using a process technology that is compatible with common transistor types can be desirable.

An LDMOS transistor 221 (i.e., LDMOS) is a transistor device that can be fabricated with common transistor types (i.e., with common process flows). While this eases fabrication, biasing the LDMOS transistor 221 may be more difficult than biasing the less common (i.e., more difficult to fabricate) transistor types. Accordingly, the voltage pre-regulator 200 further includes a bias circuit 210. The bias circuit 210 is configured to receive the input voltage ($V_{IN}$) and to generate a bias voltage ($V_{BIAS}$) and bias current ($I_{BIAS}$), which can control an operating point of an LDMOS transistor 221 of the MV-regulator 220. The bias circuit 210 may use positive feedback 211 and negative feedback 212 to help generate the bias voltage ($V_{BIAS}$) and bias current ($I_{BIAS}$).

The positive feedback 211 and the negative feedback 212 of the bias circuit 210 can operate in concert to generate the bias voltage ($V_{BIAS}$). For example, at start-up, the bias voltage ($V_{BIAS}$) quickly rises due to positive feedback 211. Negative feedback 212 limits the rise of the bias voltage to a predetermined value so that after a start-up period, the bias voltage is stabilized at the predetermined value by the opposing effects of the positive feedback 211 and the negative feedback 212.

Figure 3:
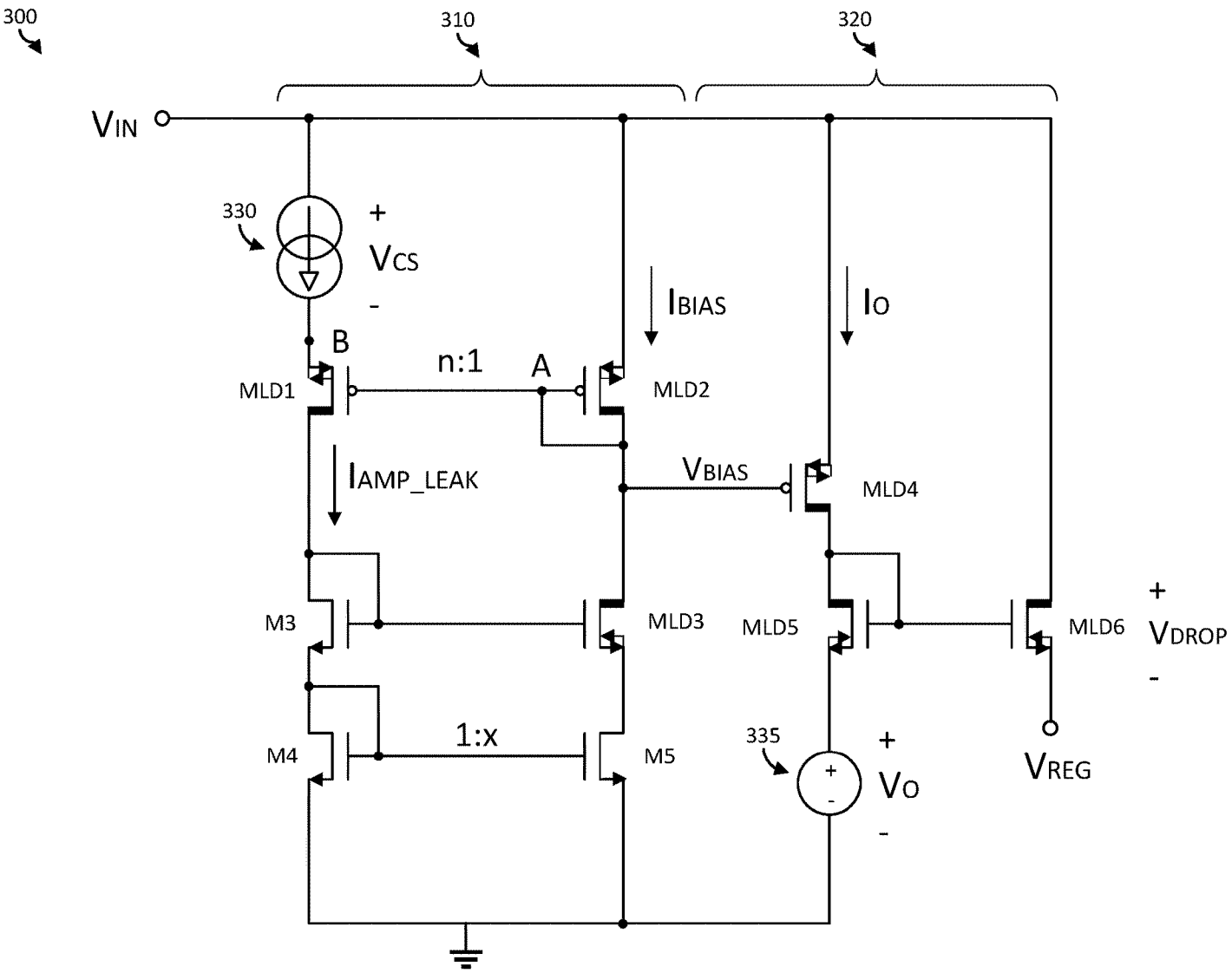
FIG. 3 is a schematic of a voltage pre-regulator according to a first possible implementation of the present disclosure.

FIG. 3 is a schematic of a voltage pre-regulator according to a possible implementation of the present disclosure. The voltage pre-regulator 300 includes a bias circuit portion 310 (i.e., bias circuit) and a MV-regulator portion 320 (i.e., MV-regulator). The bias circuit portion 310 is configured to output a bias voltage ($V_{BIAS}$) to a gate of an LDMOS transistor (i.e., MLD4) that is coupled between the input voltage ($V_{IN}$) and a current mirror (i.e., MLD5, MLD6) in the MV-regulator portion 320. The bias voltage ($V_{BIAS}$) and an output voltage source 335 ($V_O$) control the operating point of MLD4 so that an output current ($I_O$) flows through MLD4. This current is mirrored by the current mirror (i.e., MLD5, MLD6) and creates the voltage drop ($V_{DROP}$) across the LDMOS output transistor (MLD6) so that the regulated voltage ($V_{REG}$) appears at the output of the voltage pre-regulator 300. The regulated voltage ($V_{REG}$) may be approximately equal to the voltage ($V_O$) of the output voltage source 335. Additionally, the output current ($I_O$) may be approximately equal to a bias current ($I_{BIAS}$) flowing through the second LDMOS transistor (MLD2) because the fourth LDMOS transistor (MLD4) and the second LDMOS transistor (MLD2) may be approximately equal in size and because they have the same gate voltage and source voltage.

The operation of the bias circuit portion 310 of the voltage pre-regulator 300 uses positive and negative feedback. At start-up, a first node (A) and a second node (B) are coupled to the input voltage ($V_{IN}$) (i.e., the supply voltage). At start-up, a first LDMOS transistor (MLD1) is in a non-conducting state (i.e., OFF state) so that only a (small) leakage current ($I_{LEAK}$) is conducted. The leakage current (LEAK) is coupled to a first current mirror (M4, M5). The first current mirror (M4, M5) amplifies the leakage current ($I_{LEAK}$) to generate an amplified leakage current ($I_{AMP_LEAK}$). The amplification occurs because the M5 transistor of the first current mirror is x-times (e.g., 5 times) larger than the M4 transistor of the first current mirror.

The first LDMOS transistor (MLD1) is part of a second current mirror (MLD1, MLD2). The second current mirror (MLD1, MLD2) further amplifies the amplified leakage current ($I_{AMP_LEAK}$) because the first LDMOS transistor (MLD1) of the second current mirror is n-times (e.g., 5 times) larger than the second LDMOS transistor (MLD2) of the second current mirror.

After the amplification by the second current mirror (MLD1, MLD2) the amplified leakage current ($I_{AMP_LEAK}$) is fed back to the first current mirror (M4, M5) and the process repeats. In other words, a feedback loop is formed between the first current mirror (M4, M5) and the second current mirror (MLD1, MLD2). An output of the first current mirror is coupled to an input of the second current mirror and an output of the second current mirror is coupled to an input of the first current mirror. Positive feedback exists because the first current mirror is configured to amplify the amplified leakage current by a first amplification based on a first size difference between transistors (M4, M5) and the second current mirror is configured to amplify the amplified leakage current by a second amplification based on a second size difference between transistors (MLD1, MLD2). The positive feedback can quickly convert a leakage current ($I_{LEAK}$) that is very small into an amplified leakage current ($I_{AMP_LEAK}$) that is much larger. The voltage pre-regulator 300 is self-starting because the leakage current ($I_{LEAK}$) naturally occurs at startup due to device physics (e.g., a thermal response) of the transistor (MLD1).

The bias circuit portion 310 further includes an LDMOS transistor (MLD3) that is configured to provide a voltage drop from a MV range to a SOA of a LV transistor (M5) in the first current mirror (M4 M5). In other words, the LDMOS transistor (MLD3) can shield the LV transistor (M5) from damage, which could occur if a voltage in a MV range was applied to its drain. A bias transistor (M3) configures the LDMOS transistor (MLD3) to conduct the same current as the LV transistor (M5) and to drop the voltage necessary to protect the LV transistor (M5).

The positive feedback can lower the voltage at the first node (A) while the second node (B) is at the input voltage, thereby increasing the amplified leakage current ($I_{AMP_LEAK}$). To limit the increase caused by the positive feedback, the bias circuit portion includes a current source 330 that is coupled between the input of the voltage pre-regulator and the input of the first current mirror. As the amplified leakage current ($I_{AMP_LEAK}$) is increased by the positive feedback, a voltage ($V_{CS}$) is generated across the current source. The voltage ($V_{CS}$) increases as the amplified leakage current ($I_{AMP_LEAK}$) increases. In other words, above a current level, the current source 330 has a voltage ($V_{CS}$) that corresponds to the amplified leakage current ($I_{AMP_LEAK}$). This voltage can reduce the first amplification of the first current mirror as the amplified leakage current increases so that that the amplified leakage current eventually stops increasing.

At startup, the second node (B) (i.e., the source of MLD1) is at the input voltage ($V_{IN}$) (i.e., $V_{CS}$=0). When the amplified leakage current reaches a certain value, the current supplied by the current source 330 becomes limited and a voltage ($V_{CS}$) forms across the current source 330. Accordingly, the voltage of the second node drops from $V_{IN}$ according to $V_{CS}$ as the current demand on the current source 330 increases due to the positive feedback. The drop in the voltage at the second node (B) has a negative effect on the increasing the amplified leakage current ($I_{AMP_LEAK}$). For example, the gate-source voltage on a transistor (MLD1) of the second current mirror can be reduced according to the voltage of the current source, so that MLD1 conducts less as the amplified leakage current is increased. Eventually the negative effect on $I_{AMP_LEAK}$ growth caused by the current source counters the positive effect on $I_{AMP_LEAK}$ growth caused by the current mirrors.

When an equilibrium between the positive feedback and the negative feedback is reached, a voltage at the first node (A) is at a value that causes the MV-regulator portion 320 to output $V_{REG}$. The fourth LDMOS transistor (MLD4) of the MV-regulator portion 320 can be the same size at the second LDMOS transistor (MLD2) so that the output current ($I_O$) is equal to the current flowing through the second LDMOS transistor (MLD2). The equilibrium is a state of the bias circuit portion at which the effects of the positive feedback and the negative feedback are balanced so that the amplified leakage current is held at a fixed level (i.e., rather than increasing due to the positive feedback). The equilibrium corresponds to the input voltage so as the input voltage changes, the bias current and the bias voltage, which are based on the equilibrium, can change as well.

A subsequent change in $V_{IN}$ can cause the voltages at the first node A and the second node to change in response. For example, an increase in $V_{IN}$ can cause voltages at the first node (A) and the second node (B) to increase. The bias voltage ($V_{BIAS}$) is therefore raised in response to the increase in $V_{IN}$. The output current ($I_O$) is maintained because the increase in $V_{IN}$ and $V_{BIAS}$ maintains the gate-source voltage of MLD4. Additionally, the output voltage ($V_O$) is maintained. Maintaining $I_O$ and $V_O$ while increasing in $V_{IN}$ results in an increased channel resistance (i.e., resistance) of MLD6, which corresponds to an increase in $V_{DROP}$. Therefore, as VIN in raise VDROP can be increased so that $V_{REG}$ is maintained at the regulated voltage.

Figure 4:
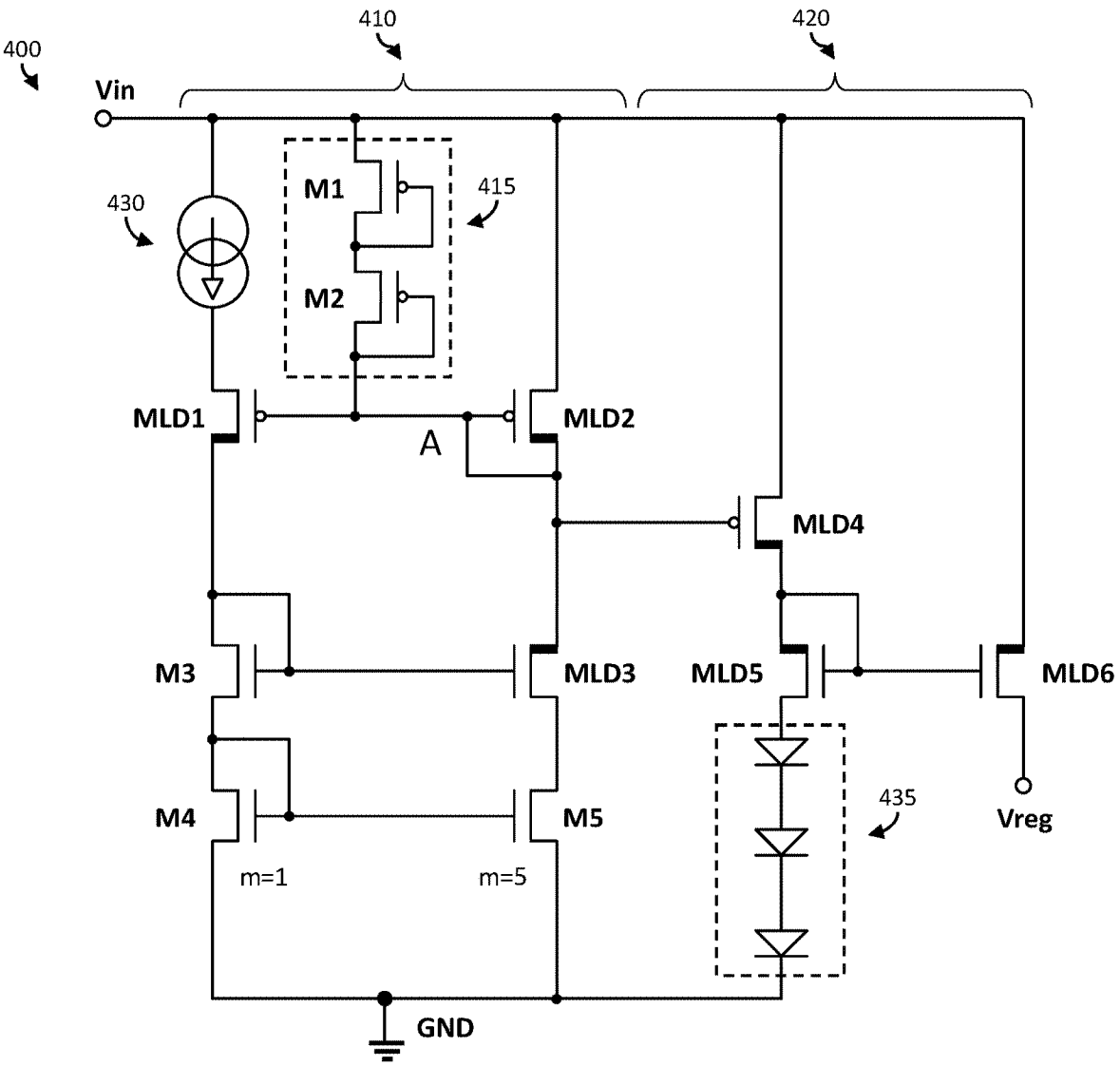
FIG. 4 is a schematic of a voltage pre-regulator according to a second possible implementation of the present disclosure.

FIG. 4 is a schematic of a voltage pre-regulator according to another possible implementation of the present disclosure. The voltage pre-regulator 400 includes a bias circuit portion 410 and a MV-regulator portion 420 as before, but in the implementation shown, the bias circuit portion 410 includes a protection circuit 415. The protection circuit can include one or more circuit elements (e.g., Zener diode, diode, diode-connected transistor, etc.) to clamp a voltage. The protection circuit 415 shown in FIG. 4 includes one or more diode-connected transistors configured to clamp a voltage difference between the input voltage ($V_{IN}$) and the first node (A) to a few volts (e.g., 5V).

The protection circuit 415 is configured to prevent a voltage across a current source 430 from exceeding a level that could cause the current source damage. For example, the current source may be implemented as a LV transistor that could be damaged by a voltage above the clamping level. The protection circuit 415 is further configured to prevent a gate-source voltage of the second LDMOS transistor (MLD2) from exceeding a level that could cause the LDMOS transistor damage. While the LDMOS transistor is configured to handle a MV between its drain and source, it may only be configured to handle a LV between its gate and source.

The protection circuit may operate in certain scenarios. For example, at start-up $V_{IN}$ may transition to a high voltage before the transistors (e.g., MLD1, MLD2) can respond. In this case, the protection circuit may clamp (i.e., hold) the voltage at a safe value until the circuit is configured in steady state.

The MV-regulator portion 420 implementation shown in FIG. 4 includes an output voltage source 435 that includes one or more diodes. The one of more diodes (e.g., three series-connected diodes) are connected in series so that the output voltage ($V_O$) is the sum of the voltage drop across each diode. The regulated voltage ($V_{REG}$) of the voltage pre-regulator 400 is approximately equal to the output voltage of the output voltage source 435.

Figure 5:
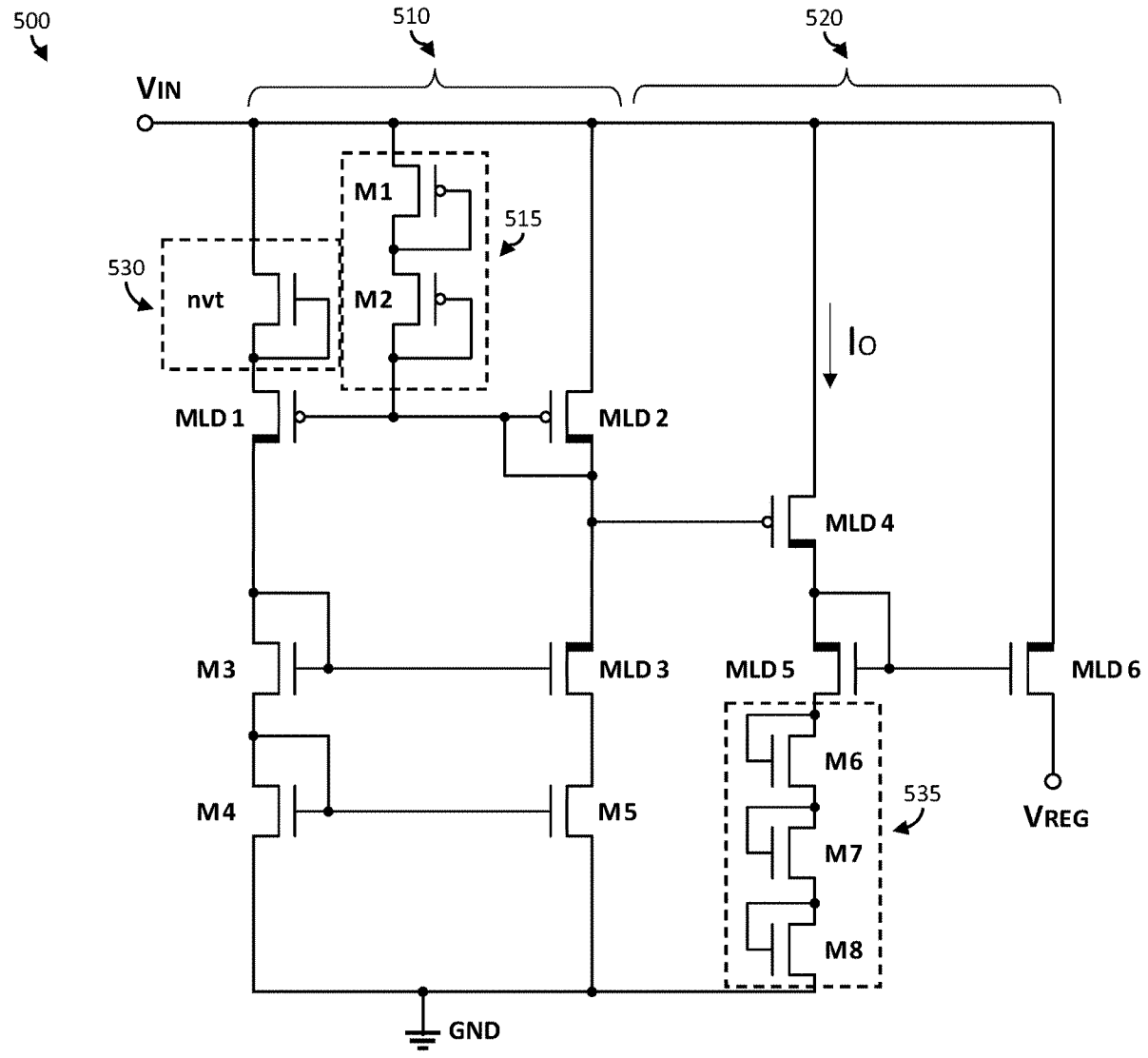
FIG. 5 is a schematic of a voltage pre-regulator according to a third possible implementation of the present disclosure.

FIG. 5 is a schematic of a voltage pre-regulator according to another possible implementation of the present disclosure. The voltage pre-regulator 500 includes a bias circuit portion 510 and a MV-regulator portion 520. The current source of the bias circuit portion 510 is implemented as a depletion-mode native transistor (i.e., NVT 530). The NVT 530 can be a LV device. Accordingly, the implementation shown includes a protection circuit 515 to prevent damage to the NVT (and MLD2), as described previously. A gate terminal of the NVT is connected to a source terminal of the NVT. In operation, the voltage drop across the NVT 530 is practically zero until the current through the NVT reached a value (e.g., limit) based on the dimensions of the NVT. A voltage will be generated across the NVT 530 as the current demand is increased above this value. Dimensions of the NVT (e.g., length) can be selected (e.g., made long) so that the NVT has a high resistance.

As shown in FIG. 5, an output voltage source 535 of the MV-regulator portion 520 can be implemented as one or more diode-connected transistors (M6, M7, M8). The one of more (e.g., 3) diodes-connected transistor (M6, M7, M8) are series connected so that the output voltage ($V_O$) is the sum of the voltage drop across each diode-connected transistor. The regulated voltage ($V_{REG}$) of the voltage pre-regulator 500 is approximately equal to the output voltage of the output voltage source 535. The voltage pre-regulator 500 can output a current is approximately equal to $I_O$ which, in turn, is approximately equal to a current flowing through the second LDMOS transistor (MLD2). This current is determined by an operating point (i.e., equilibrium point) of MLD2, which is based on the balance between the positive feedback and negative feedback of the bias circuit portion 510. In other implementations the output voltage source 535 can be implemented as a Zener diode.

Figure 6:
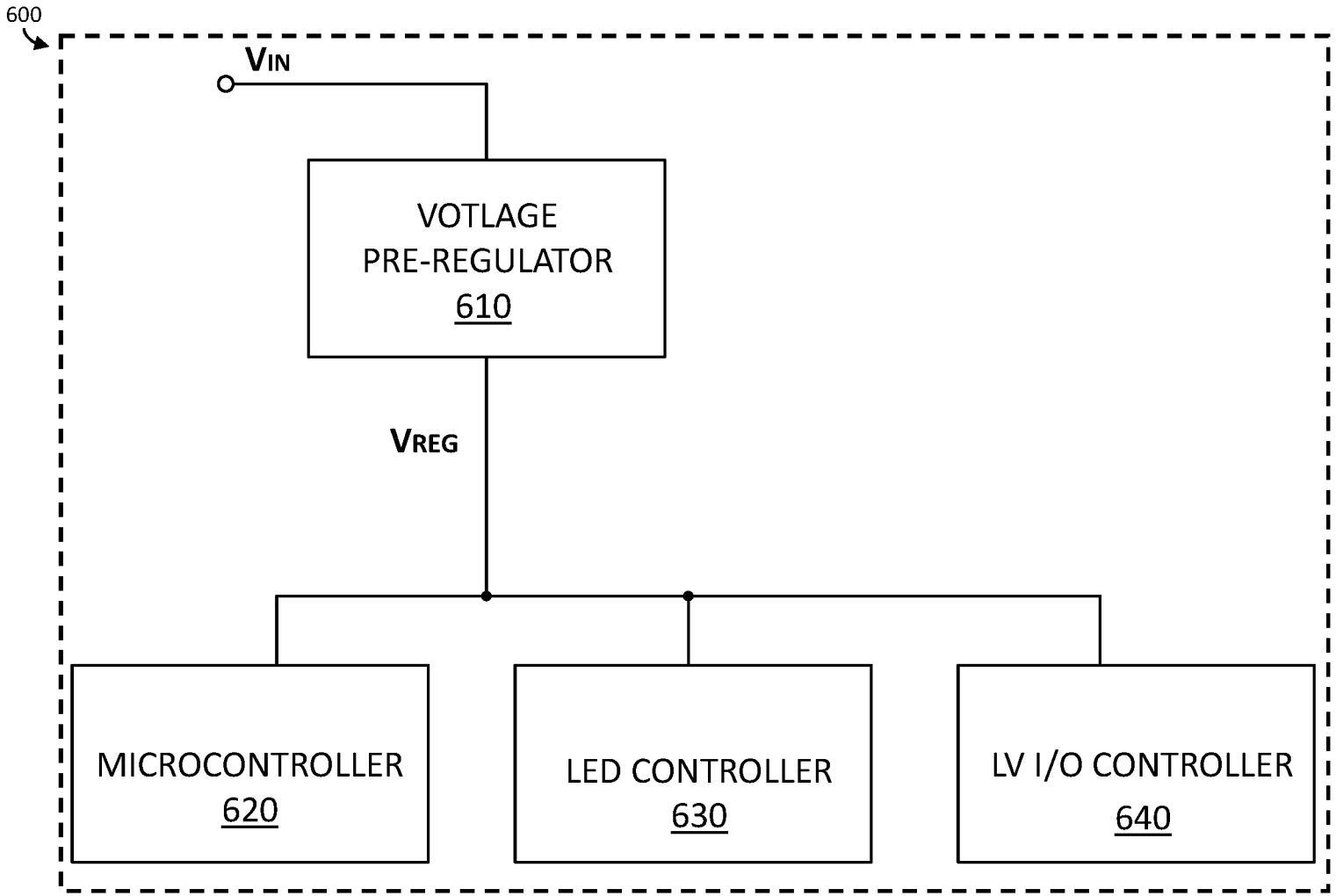
FIG. 6 is a block diagram of a system including a voltage pre-regulator according to a possible implementation of the present disclosure.

FIG. 6 is a block diagram of a system including a voltage pre-regulator according to a possible implementation of the present disclosure. The system may include a number of subsystems configured for various functions. For example, the system 600 may be a mobile device that includes a microcontroller 620, an LED controller 630, and a LV input/output (I/O) controller 640. The system may include a battery (not shown) configured to generate a supply voltage (i.e., first rail voltage). The supply voltage (i.e., $V_{IN}$) may be in a MV range. Accordingly, the system may include a voltage pre-regulator that is configured to receive the first rail voltage (i.e., $V_{IN}$) and to output a second rail voltage (i.e., $V_{REG}$) that is lower than the first rail voltage. For example, the second rail voltage may be in a LV range. Accordingly, the microcontroller 620, the LED controller 630, and the LV I/O controller 640, which operate in a LV range, can be coupled to the second rail voltage ($V_{REG}$) without damage. The subsystems may further convert and/or regulate the second rail voltage. For example, the LV I/O controller may include a linear regulator (not shown) to create a regulated voltage that is lower than the second supply rail voltage ($V_{REG}$) as a supply voltage for its circuit. The voltage pre-regulator 610, may facilitate any up/down DC/DC or regulation using standard LV devices.

Figure 7:
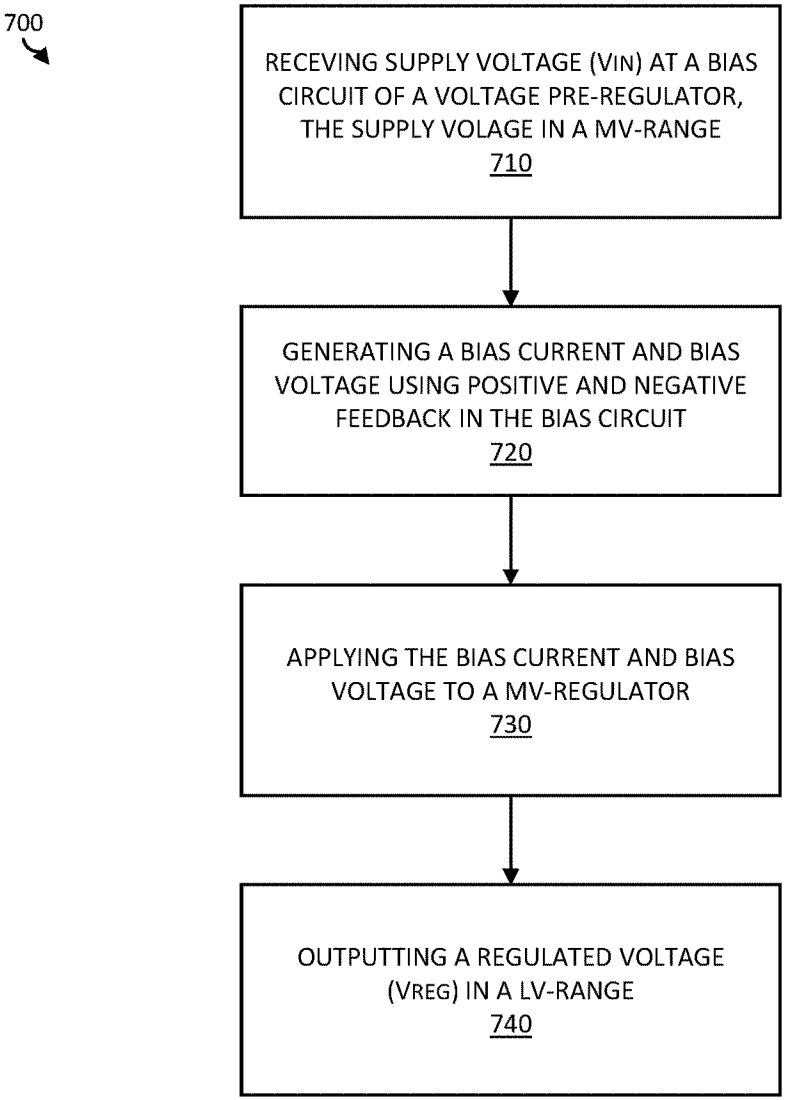
FIG. 7 is a flowchart of a method for voltage pre-regulation according to a possible implementation of the present disclosure.

FIG. 7 is a flowchart of a method for voltage pre-regulation according to a possible implementation of the present disclosure. The method 700 includes receiving 710 a supply voltage ($V_{IN}$) at a bias circuit portion (i.e., bias circuit) of a voltage pre-regulator. The supply voltage is in a MV range. The method further includes generating 720 a bias current ($I_{BIAS}$) and a bias voltage ($V_{BIAS}$) using positive and negative feedback in the bias circuit. For example, the positive feedback may include amplifying a leakage current using current mirrors with transistors of different dimensions. The current mirrors can include two current mirrors that are configured in a feedback loop for the amplified leakage current. The negative feedback may include adjusting the voltage of one of the current mirrors based on a level of the amplified leakage current. For example, the adjusting can include reducing a voltage on a transistor of one of the current mirrors using a current source that is coupled between the input voltage and the transistor, the current source having a voltage that depends on the current through the transistor. The method further includes applying 730 (i.e., outputting, coupling, transmitting) the bias current and the bias voltage to a MV-regulator portion (i.e., MV-regulator) of the voltage pre-regulator. The MV-regulator portion may include a voltage source (e.g., series connected diodes, series connected diode-connected transistors) and the regulated voltage may approximately equal (e.g., within a volt) a voltage level ($V_O$) of the voltage source. The method further includes outputting 740 a regulated voltage ($V_{REG}$) that is in an LV-range. For example, MV-regulator may include a voltage source and the regulated voltage may be made approximately equal to an output voltage ($V_O$) of the voltage source by a voltage drop ($V_{DROP}$) that is controlled by (i.e., based on) the bias current ($I_{BIAS}$) and the bias voltage ($V_{BIAS}$) received from the bias circuit.

While certain features of the described implementations have been illustrated as described herein, many modifications, substitutions, changes and equivalents will now occur to those skilled in the art. For example, pre-regulators may be made to convert a voltage in a high voltage (i.e., HV) range (e.g., >100V) to a voltage within a safe operating area of a LV device. This may be due, in part, to the LDMOS devices used. In some possible implementations, these devices may be configured to handle HV at their drain terminals (or gate terminals). Further various devices may be used to generate/clamp voltages between terminals. While diodes and diode-connected transistors have been described in the implementations shown, a Zener diode may be suitable as well. It is, therefore, to be understood that the appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or sub-combinations of the functions, components and/or features of the different implementations described.

In the specification and/or figures, typical embodiments have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

Unless defined otherwise, all technical and scientific terms used herein have the same meaning as commonly understood by one of ordinary skill in the art. Methods and materials similar or equivalent to those described herein can be used in the practice or testing of the present disclosure. As used in the specification, and in the appended claims, the singular forms "a," "an," "the" include plural referents unless the context clearly dictates otherwise. The term "comprising" and variations thereof as used herein is used synonymously with the term "including" and variations thereof and are open, non-limiting terms. The terms "optional" or "optionally" used herein mean that the subsequently described feature, event or circumstance may or may not occur, and that the description includes instances where said feature, event or circumstance occurs and instances where it does not. Ranges may be expressed herein as from "about" one particular value, and/or to "about" another particular value. When such a range is expressed, an aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

Some implementations may be implemented using various semiconductor processing and/or packaging techniques. Some implementations may be implemented using various types of semiconductor processing techniques associated with semiconductor substrates including, but not limited to, for example, Silicon (Si), Gallium Arsenide (GaAs), Gallium Nitride (GaN), Silicon Carbide (SiC) and/or so forth.

It will be understood that, in the foregoing description, when an element is referred to as being on, connected to, electrically connected to, coupled to, or electrically coupled to another element, it may be directly on, connected or coupled to the other element, or one or more intervening elements may be present. In contrast, when an element is referred to as being directly on, directly connected to or directly coupled to another element, there are no intervening elements present. Although the terms directly on, directly connected to, or directly coupled to may not be used throughout the detailed description, elements that are shown as being directly on, directly connected or directly coupled can be referred to as such. The claims of the application, if any, may be amended to recite exemplary relationships described in the specification or shown in the figures.

As used in this specification, a singular form may, unless definitely indicating a particular case in terms of the context, include a plural form. Spatially relative terms (e.g., over, above, upper, under, beneath, below, lower, and so forth) are intended to encompass different orientations of the device in use or operation in addition to the orientation depicted in the figures. In some implementations, the relative terms above and below can, respectively, include vertically above and vertically below. In some implementations, the term adjacent can include laterally adjacent to or horizontally adjacent to.

The invention claimed is:

1. A voltage pre-regulator, comprising:

a bias circuit portion including:

a feedback loop configured to amplify a leakage current created by an input voltage so that the leakage current increases according to a positive feedback to become an amplified leakage current, and a current source coupled to the feedback loop that is configured to an increase of the amplified leakage current by applying a negative feedback to the feedback loop so that the bias circuit portion outputs a bias current and a bias voltage; and a regulator circuit portion including a laterally diffused metal oxide semiconductor (LDMOS) transistor configured to generate a voltage drop from an input of the voltage pre-regulator to an output of the voltage pre-regulator based on the bias current and the bias voltage, the voltage pre-regulator configured to output a regulated voltage based on the voltage drop.

2. The voltage pre-regulator according to claim 1, wherein the input voltage is in a middle voltage (MV) range and the regulated voltage is in a low voltage (LV) range.

3. The voltage pre-regulator according to claim 1, wherein the feedback loop includes a first current mirror and a second current mirror, an output of the first current mirror coupled to an input of the second current mirror and an output of the second current mirror coupled to an input of the first current mirror.

4. The voltage pre-regulator according to claim 3, wherein the first current mirror is configured to amplify the leakage current by a first amplification based on a first size difference between transistors of the first current mirror; and the second current mirror is configured to amplify the leakage current by a second amplification based on a second size difference between transistors of the second current mirror.

5. The voltage pre-regulator according to claim 4, wherein the current source is coupled between the input of the voltage pre-regulator and the input of the first current mirror, the current source having a voltage corresponding to the amplified leakage current, the voltage reducing the first amplification of the first current mirror as the amplified leakage current increases.

6. The voltage pre-regulator according to claim 5, wherein the current source is a depletion-mode native transistor (NVT).

7. The voltage pre-regulator according to claim 5, further including a protection circuit coupled between the input and the first current mirror, the protection circuit configured to clamp the voltage of the current source to protect the current source from damage.

8. The voltage pre-regulator according to claim 1, wherein the regulator circuit portion includes a voltage source, the regulated voltage approximately equal to the voltage source.

9. The voltage pre-regulator according to claim 8, wherein the voltage source includes a diode or a plurality of series-connected diodes.

10. The voltage pre-regulator according to claim 8, wherein the voltage source includes a diode-connected transistor or a plurality of diode-connected transistors coupled in series.

11. The voltage pre-regulator according to claim 1, wherein the bias circuit portion is self-starting upon application of the input voltage.

12. The voltage pre-regulator according to claim 1, wherein the positive feedback and the negative feedback balance at an equilibrium corresponding to the input voltage, the bias current and the bias voltage based on the equilibrium.

13. A method for voltage pre-regulation, the method comprising:

receiving an input voltage at a bias circuit portion of a voltage pre-regulator;

amplifying a leakage current created by the input voltage so that the leakage current increases according to a positive feedback to become an amplified leakage current;

limiting an increase of the amplified leakage current by applying a negative feedback;

generating a bias current and a bias voltage using the positive feedback and the negative feedback in the bias circuit portion of the voltage pre-regulator;

applying the bias current and the bias voltage to a regulator circuit portion of the voltage pre-regulator; and outputting a regulated voltage based on a voltage drop from the input voltage, the voltage drop generated by the bias current and the bias voltage.

14. The method for voltage pre-regulation according to claim 13, wherein the input voltage is in a middle voltage (MV) range and the regulated voltage is in a low voltage (LV) range.

15. The method for voltage pre-regulation according to claim 13, wherein the positive feedback includes amplifying a leakage current to generate an amplified leakage current using current mirrors, each current mirror having transistors of different dimensions.

16. The method for voltage pre-regulation according to claim 15, wherein the current mirrors include two current mirrors configured in a feedback loop.

17. The method for voltage pre-regulation according to claim 16, wherein the negative feedback includes adjusting a voltage of one of the two current mirrors based on a level of the amplified leakage current to reduce an amplification of the feedback loop.

18. The method for voltage pre-regulation according to claim 17, wherein the adjusting includes reducing a gate-source voltage on a transistor of one of the current mirrors according to a voltage of a current source that is coupled between the input voltage and the transistor, the voltage of the current source corresponding to a level of the amplified leakage current.

19. A system comprising:

a low voltage device including transistors having a safe operating area in a low voltage range; and a voltage pre-regulator coupled to an input voltage that is outside the safe operating area and configured to provide a regulated voltage to the low voltage device in the safe operating area, the voltage pre-regulator including:

a bias circuit portion including:

a feedback loop configured to amplify a leakage current created by an input voltage to generate an amplified leakage current that increases according to a positive feedback, and a current source coupled to the feedback loop that is configured to limit an increase of the amplified leakage current by applying a negative feedback to the feedback loop so that an equilibrium is reached between the positive feedback and the negative feedback, wherein at the equilibrium the bias circuit portion outputs a bias current and a bias voltage, and a regulator circuit portion including a laterally diffused metal oxide semiconductor (LDMOS) transistor configured to generate a voltage drop from an input of the voltage pre-regulator to an output of the voltage pre-regulator based on the bias current and the bias voltage, the voltage pre-regulator configured to output a regulated voltage based on the voltage drop.

20. The system according to claim 19, wherein the low voltage device is a low voltage regulator.

21. The system according to claim 19, wherein the low voltage device and the voltage pre-regulator are portions of a unitary integrated circuit.

* * * * *